US010276989B2

(12) United States Patent
Zhang et al.

(10) Patent No.: US 10,276,989 B2
(45) Date of Patent: Apr. 30, 2019

(54) ELECTRICAL CONNECTOR WITH INTIMATE SIDE ARMS EXTENDING FROM METALLIC SHELL AND INTEGRALLY FORMED WITHIN INSULATIVE SHELL

(71) Applicant: FOXCONN INTERCONNECT TECHNOLOGY LIMITED, Grand Cayman (KY)

(72) Inventors: Cai-Yun Zhang, Huaian (CN); Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/847,865

(22) Filed: Dec. 19, 2017

(65) Prior Publication Data

US 2018/0175560 A1 Jun. 21, 2018

(30) Foreign Application Priority Data

Dec. 19, 2016 (CN) ..... 2016 2 1396579 U
Mar. 3, 2017 (CN) ..... 2017 2 0206129 U

(51) Int. Cl.

| | |
|---|---|
| ***H01R 12/71*** | (2011.01) |
| ***H01R 13/52*** | (2006.01) |
| ***H01R 24/60*** | (2011.01) |
| ***H01R 107/00*** | (2006.01) |

(Continued)

(52) U.S. Cl.

CPC ..... *H01R 13/6594* (2013.01); *H01R 12/71* (2013.01); *H01R 12/716* (2013.01); *H01R 13/5202* (2013.01); *H01R 13/6581* (2013.01); *H01R 13/5216* (2013.01);

(Continued)

(58) Field of Classification Search

CPC ..... H01R 43/24; H01R 13/6581; H01R 13/6593; H01R 13/65802; H01R 23/6873; H01R 23/025; H01R 23/7073; H01R 13/6594; H01R 13/5202; H01R 13/5216;

(Continued)

(56) References Cited

U.S. PATENT DOCUMENTS 6,910,914 B1 * 6/2005 Spink, Jr. ..... H01R 13/6593 439/497
8,388,379 B2 * 3/2013 Sasaki ..... H01R 12/724 439/607.35

(Continued)

*Primary Examiner* — Gary F Paumen
(74) *Attorney, Agent, or Firm* — Wei Te Chung; Ming Chieh Chang

(57) ABSTRACT

An electrical connector includes a contact module enclosed within a metallic inner shell. The inner shell is formed by stamping and forming, and includes opposite first and second side walls in a vertical direction, and a pair of end walls opposite to each other in the transverse direction and linking the opposite first and second side walls in the vertical direction. Each end wall includes a first arm extending rearwardly from a rear edge and a second arm intimately located beside the first arm either in a unitarily folded manner or a discretely soldered manner. The second arm is located outside of the corresponding first arm in the transverse direction wherein the first arm forms a first mounting leg and the second arm forms a second mounting leg extending through an insulative outer shell which is overmolded upon the inner shell.

19 Claims, 22 Drawing Sheets

(51) Int. Cl.
*H01R 13/6581* (2011.01)
*H01R 13/6594* (2011.01)

(52) U.S. Cl.
CPC ..... *H01R 13/5219* (2013.01); *H01R 24/60* (2013.01); *H01R 2107/00* (2013.01)

(58) Field of Classification Search
CPC .. H01R 13/5219; H01R 12/71; H01R 12/716; H01R 2107/00; H01R 24/60
USPC ..... 439/607.35–607.4, 604–606
See application file for complete search history.

(56) References Cited

U.S. PATENT DOCUMENTS 8,535,097 B2 * 9/2013 Yen ..... H01R 13/6594 439/607.27
8,708,744 B2 * 4/2014 Masumoto ..... H01R 13/6594 439/607.4
8,882,540 B2 * 11/2014 Yen ..... H01R 27/00 439/489
8,974,249 B2 * 3/2015 Zhang ..... H01R 12/724 439/607.4
9,711,908 B2 * 7/2017 Yao ..... H01R 13/6471
2009/0253297 A1 * 10/2009 Kamata ..... H01R 12/724 439/607.35
2011/0086546 A1 * 4/2011 Mao ..... H01R 12/7052 439/607.4
2012/0231661 A1 * 9/2012 Song ..... H01R 12/707 439/607.4
2013/0203290 A1 * 8/2013 Zhang ..... H01R 12/724 439/607.36
2015/0255905 A1 * 9/2015 Little ..... H01R 13/6658 439/78
2015/0318643 A1 * 11/2015 Lane ..... H01R 12/716 439/607.35
2017/0271822 A1 9/2017 Zhang

* cited by examiner

610

600

ELECTRICAL CONNECTOR WITH INTIMATE SIDE ARMS EXTENDING FROM METALLIC SHELL AND INTEGRALLY FORMED WITHIN INSULATIVE SHELL

FIELD OF THE DISCLOSURE

The invention is related to an electrical connector, and particularly to the connector with the side legs extending from the shell and commonly integrally formed within the insulative outer shell.

DESCRIPTION OF RELATED ARTS

U.S. Pat. No. 9,711,908 discloses the electrical connector having a contact module enclosed within a metallic main shell which is further enclosed within a metallic sub-shell wherein the main shell has no opening for assuring EMI (Electromagnetic Interference) shielding while the sub-shell has openings to form the corresponding mounting legs for mounting to the printed circuit board. Anyhow, a minor gap exists between the main shell and the sub-shell, thus diminishing the waterproof performance of the connector.

It is desired to provide a connector with a reliable waterproof performance.

SUMMARY OF THE DISCLOSURE

To achieve the above desire, an electrical connector includes a contact module enclosed within a metallic inner shell. The contact module includes an insulative housing and a plurality of contacts retained in the housing. The housing includes a base and a tongue portion extending forwardly from the base. The inner shell is formed by stamping and forming, and includes opposite first and second side walls in a vertical direction, and a pair of end walls opposite to each other in the transverse direction and linking the opposite first and second side walls in the vertical direction. The inner shell forms a mating cavity enclosing the tongue portion. Each end wall includes a first arm extending rearwardly from a rear edge and a second arm intimately located beside the first arm either in a unitarily folded manner or a discretely soldered manner. The second arm is located outside of the corresponding first arm in the transverse direction wherein the first arm forms a first mounting leg and the second arm forms a second mounting leg extending through an insulative outer shell which is over-molded/insert-molded upon the inner shell.

DETAILED DESCRIPTION OF THE PREFERRED EMBODIMENT

Figure 1:
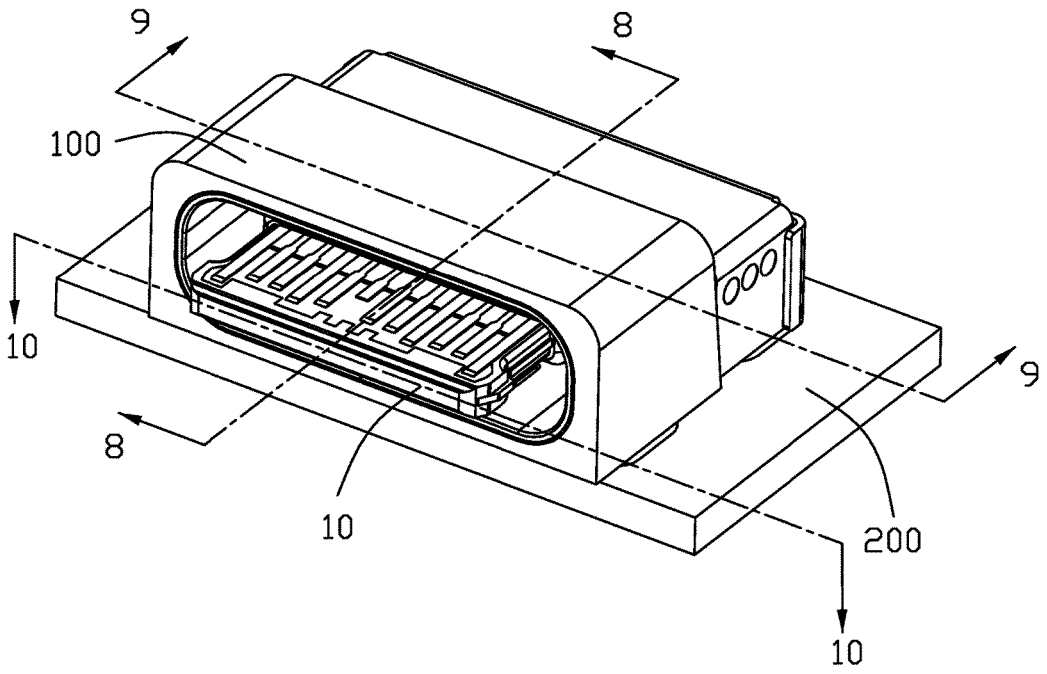
FIG. 1 is a perspective view of the electrical connector assembly of the invention.
Figure 1A:
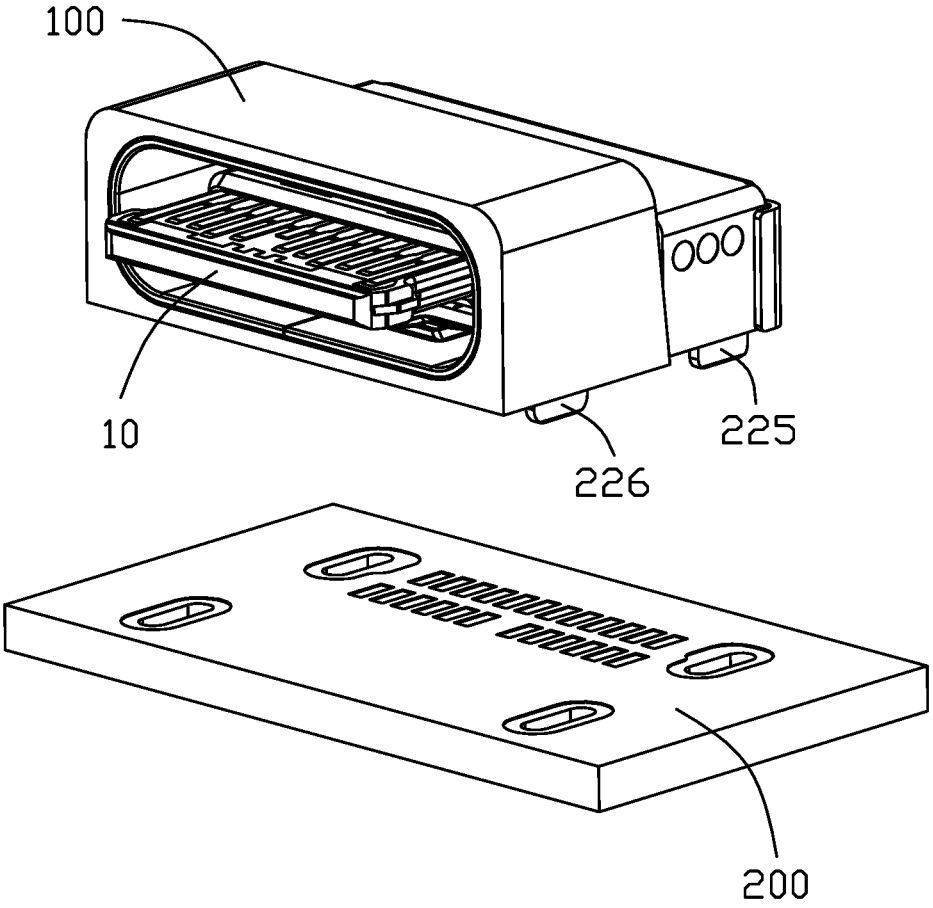
FIG. 1(A) is an exploded perspective view of the electrical connector assembly of FIG. 1 according to a first embodiment of the invention.
Figure 2:
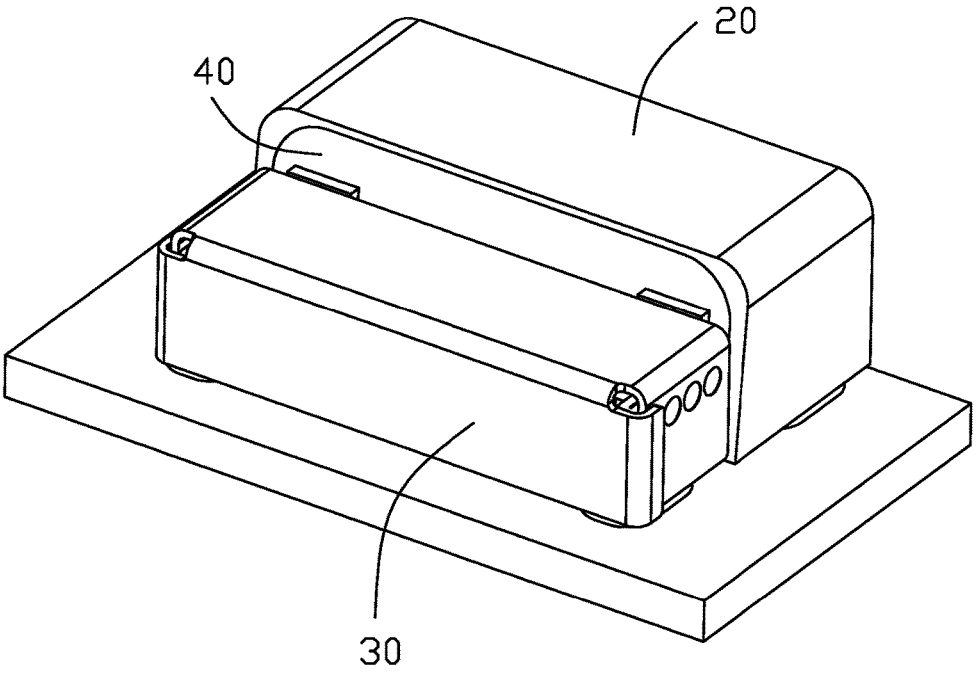
FIG. 2 is another perspective view of the electrical connector assembly of FIG. 2.
Figure 3:
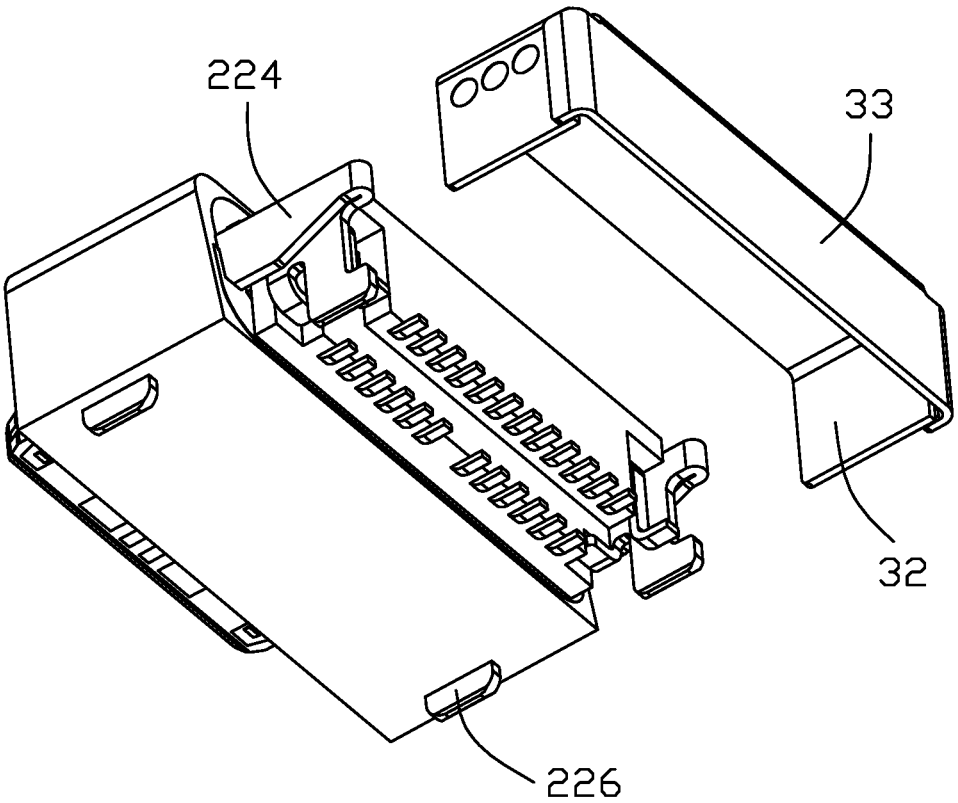
FIG. 3 is an exploded perspective view of the electrical connector of FIG. 3.
Figure 4:
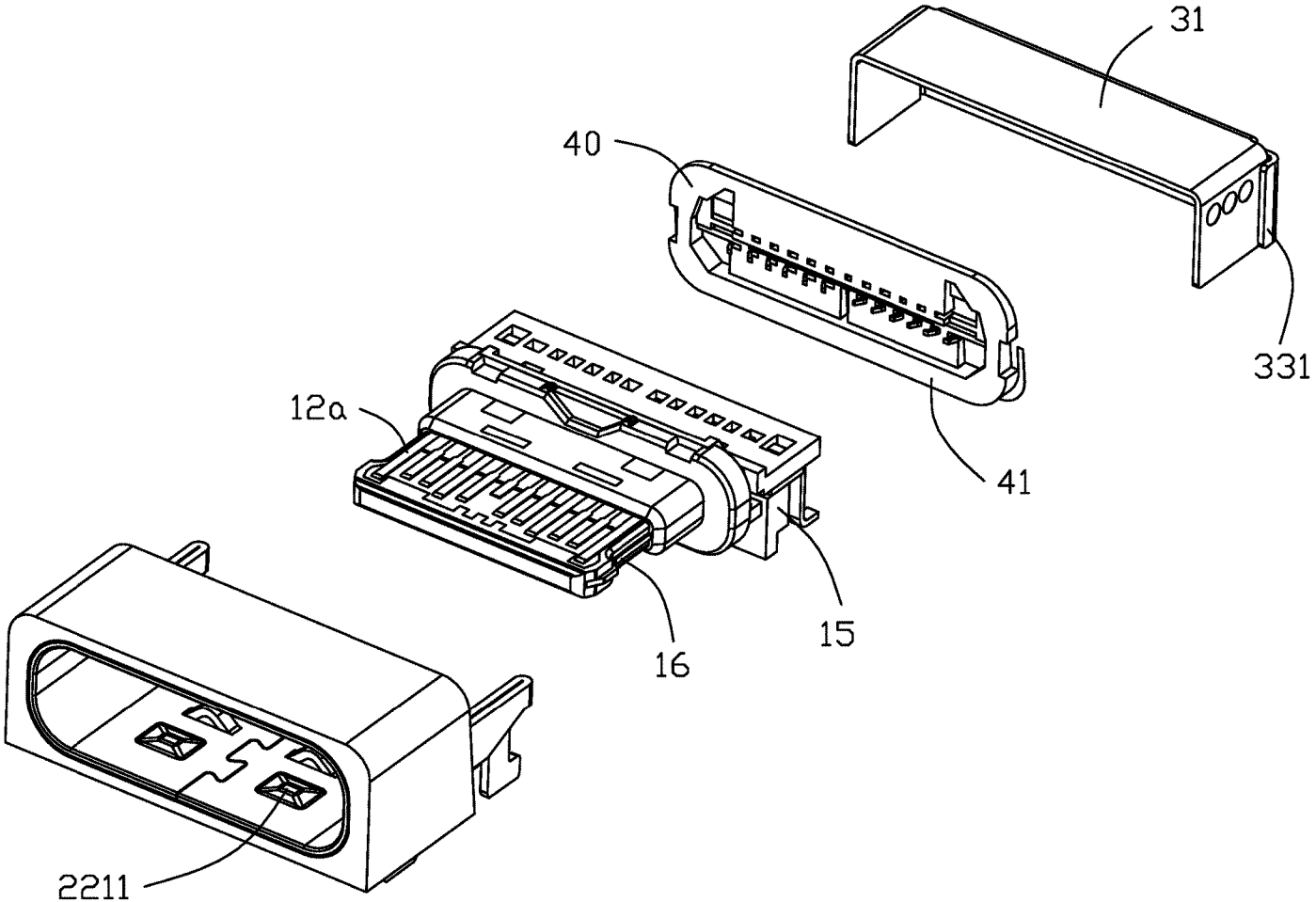
FIG. 4 is a further exploded perspective view of the electrical connector of FIG. 1.
Figure 5:
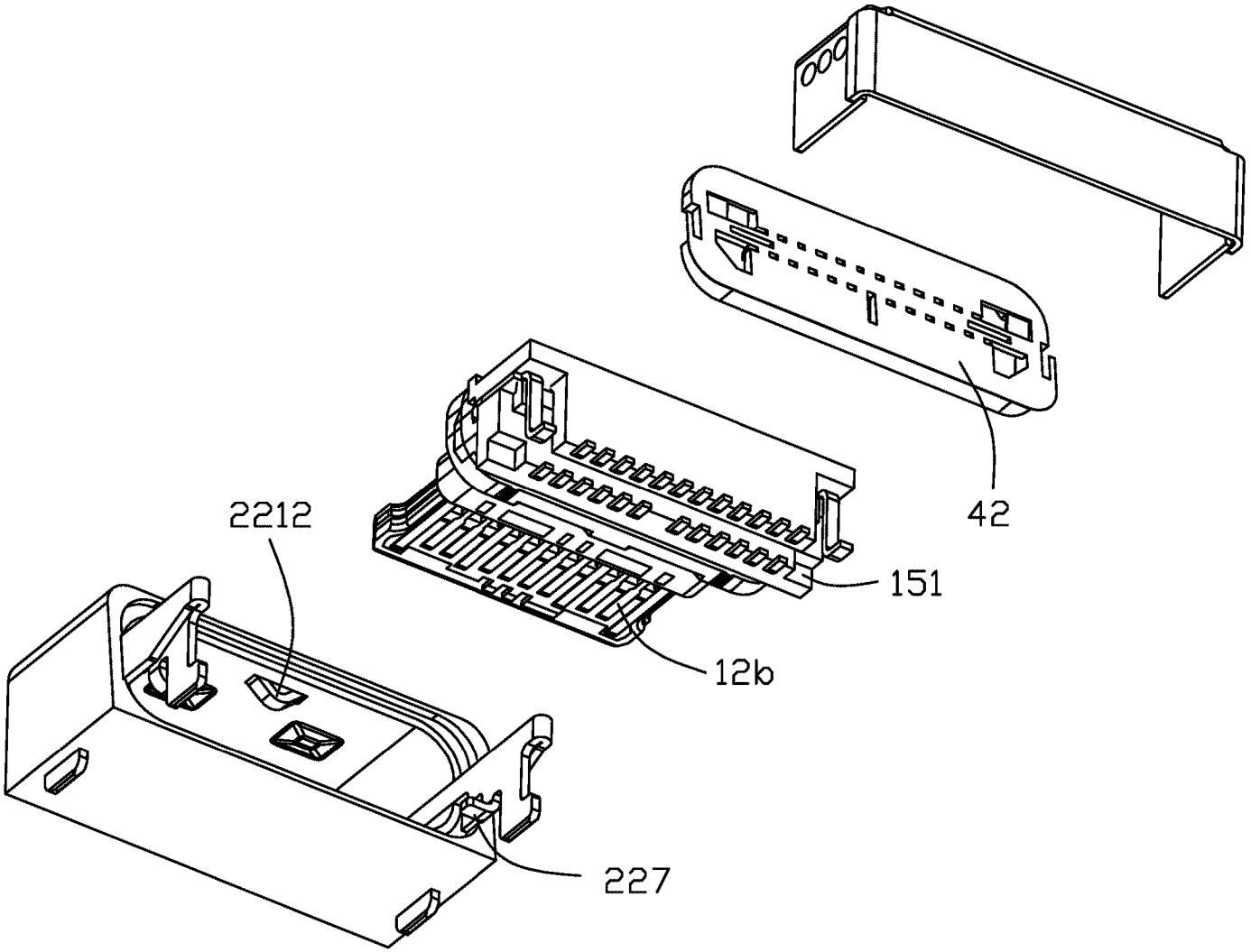
FIG. 5 is another exploded perspective view of the electrical connector of FIG. 1.
Figure 6:
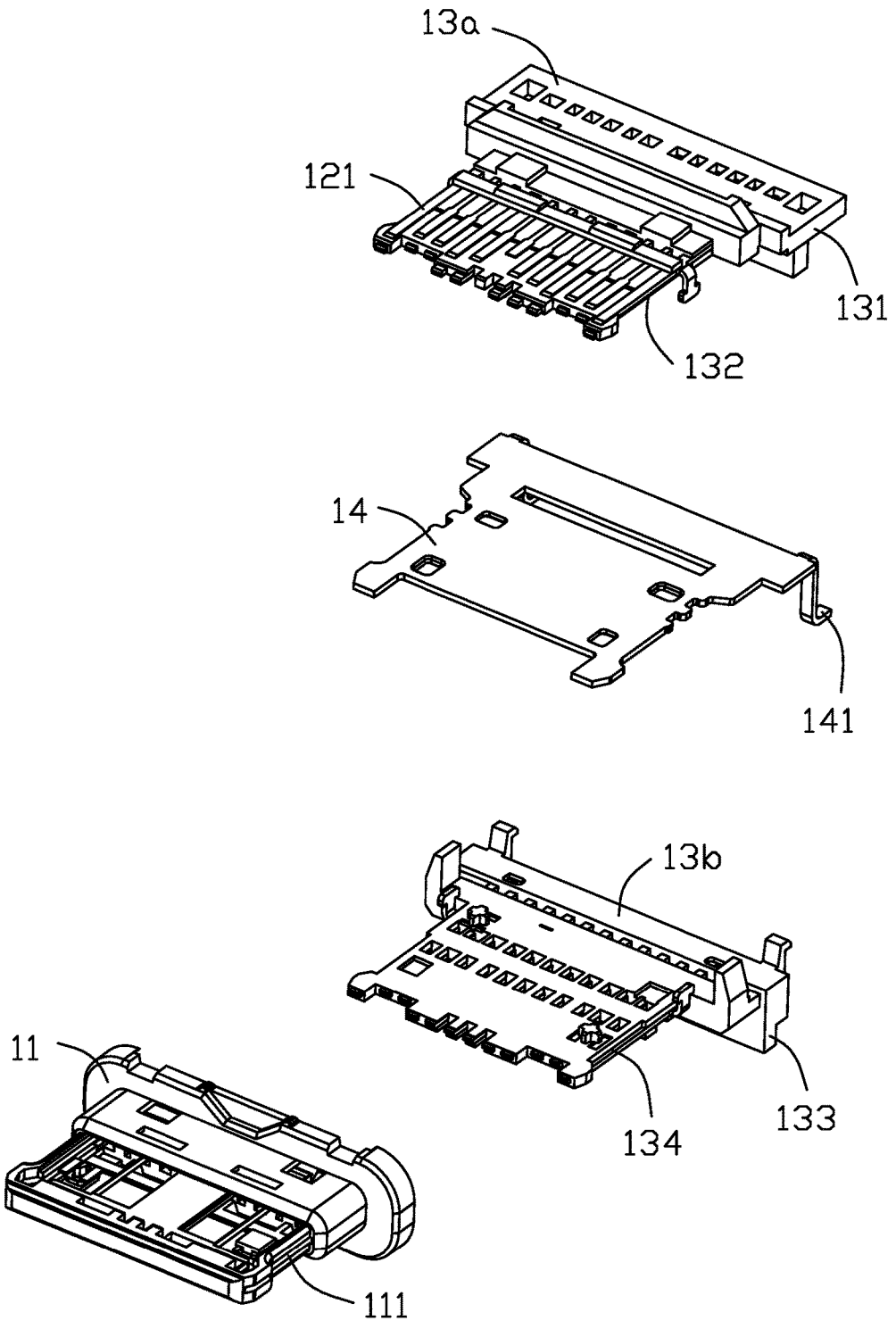
FIG. 6 is an exploded perspective view of the contact module of the electrical connector of FIG. 4.
Figure 7:
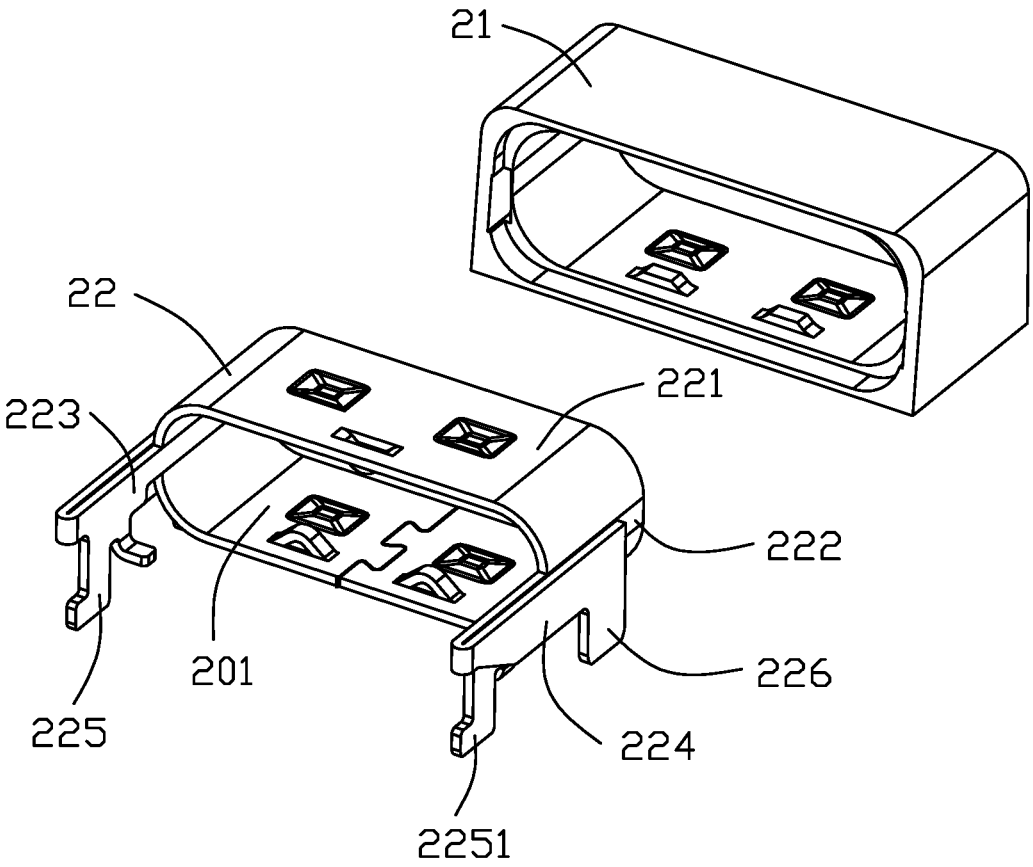
FIG. 7 is an exploded perspective view of the shell assembly of the electrical connector of FIG. 3.

Reference will now be made in detail to the embodiments of the present disclosure. Referring to FIGS. 1-10, an electrical connector 100 is mounted to a printed circuit board 200 wherein the printed circuit board 200 forms a notch in a front edge in which the connector 100 is disposed. The printed circuit board 200 is essentially located at a mid-level of the electrical connector 100.

The contact module 10 includes an insulative housing (not labeled) and a plurality of contacts 12. The contacts 12 include upper contacts 12*a* and lower contacts 12*b*. The contact module 10 further includes upper insulator 13*a* to be integrally formed with the upper contacts 12*a* therein, the lower insulator to be integrally formed with the lower contacts 12*b* therein, and the metallic shielding plate 14 therebetween. A third insulator 11 are over-molded upon the upper insulator 13*a* and the lower insulator 13*b*. The upper insulator 13*a* includes a first base 131 and the first tongue portion 132 extending from the first base 131 forwardly. The lower insulator 13*b* includes a second base 133 and a second tongue portion 134 extending forwardly from the second base 133. The first base 131 and the second base 133 commonly form the base 15. The third insulator 11 includes a third tongue portion 111, and the first tongue portion 132, the second tongue portion 134 and the third insulator 111 commonly form the tongue portion 16 extending forwardly from the base 15. The contact 12 includes a front contacting section 122, the rear soldering section 123. The shielding plate 14 includes soldering legs 14 for mounting to the printed circuit board 200. Understandably, the first insulator 13*a*, the second insulator 13*b* and the third insulator 11 commonly form the housing.

A front/first cover 20 includes an insulative outer shell 21 and a metallic inner shell 22 integrally formed with each other via an insert-molding process. The inner shell 22 includes two long sides 221 and two short sides 222 to commonly form the mating cavity 201. The tongue portion 16 is received within the mating cavity 201 and extends forwardly out of the front cover 20. The inner shell 22 includes a first/inner arm 223 extending rearwardly and a second/outer arm 224 extending forwardly from an end of the first arm 223 in a folded manner wherein the first/inner arm 223 is located at an inner side while the second/outer arm 224 is locate at an outer side in the transverse direction. The first arm 223 forms a first soldering leg 225 around a rear/free end, and the second arm 224 forms a second soldering leg 226 around the front/free end. The first soldering leg 225 forms a horizontal soldering section 2251 exposed outside of the housing for surface mounting while the second soldering leg 226 extends downwardly through the outer shell 21. The first arm 223 further include a fixing leg 227 in front of the first soldering leg 225 extending toward the contact module in the transverse direction, and the base 15 forms the corresponding recess 151 to receive the corresponding fixing leg 227. Understandably, the fixing leg 227 is bent after the contact module 10 is received within the front cover 20 for preventing backward movement of the contact module 10 from the front cover 20. The long side 221 of the inner shell 22 forms protrusion 2212 to rearwardly abut against the base 15. Notably, the second soldering leg 226 is located around a rear region of the front cover 2.

The metallic rear/second cover 30 includes a top wall 31, and a pair of side walls 32 and a rear wall 33. The second arm 224 are soldered to the side wall 32. The rear wall 33 includes a fixing part 331 to cover the side wall 32.

Figure 8:
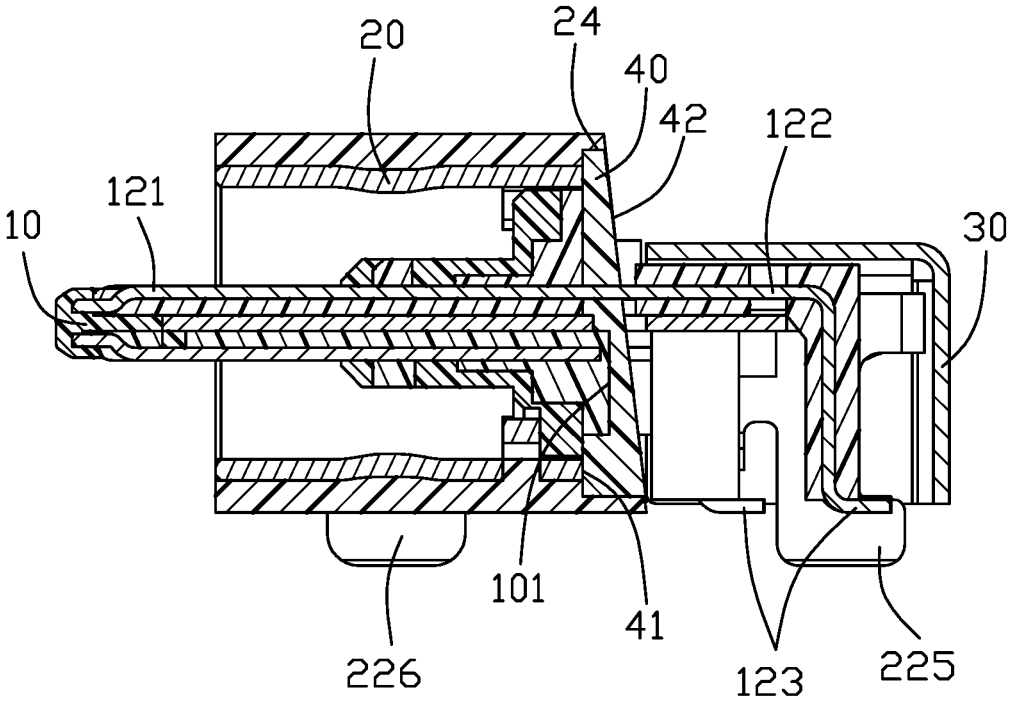
FIG. 8 is a cross-sectional view of the electrical connector of FIG. 3.
Figure 9:
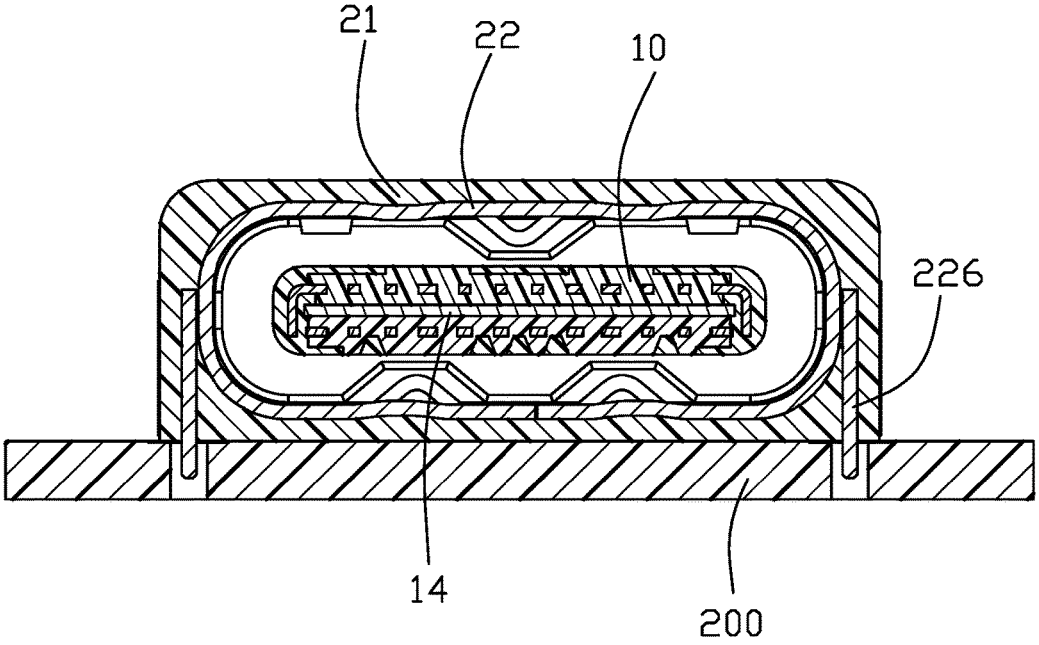
FIG. 9 is another cross-sectional view of the electrical connector of FIG. 3.
Figure 10:
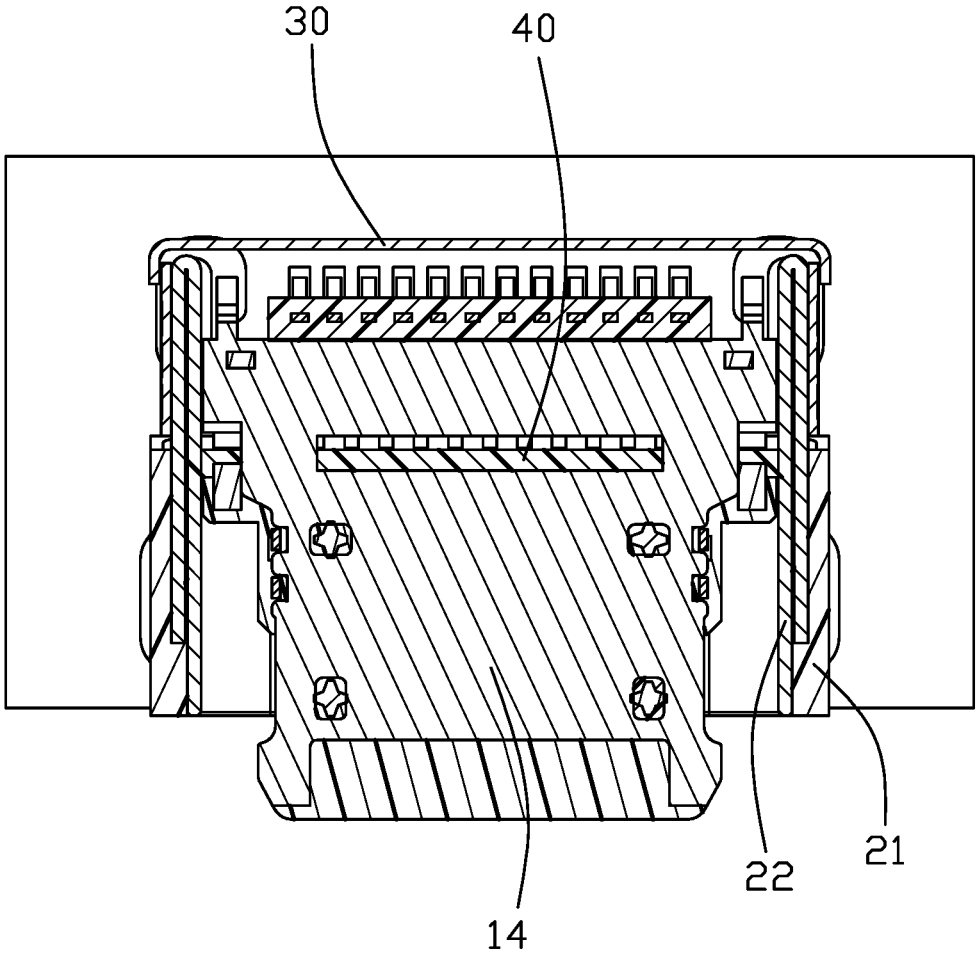
FIG. 10 is another cross-sectional view of the electrical connector of FIG. 3.
Figure 11:
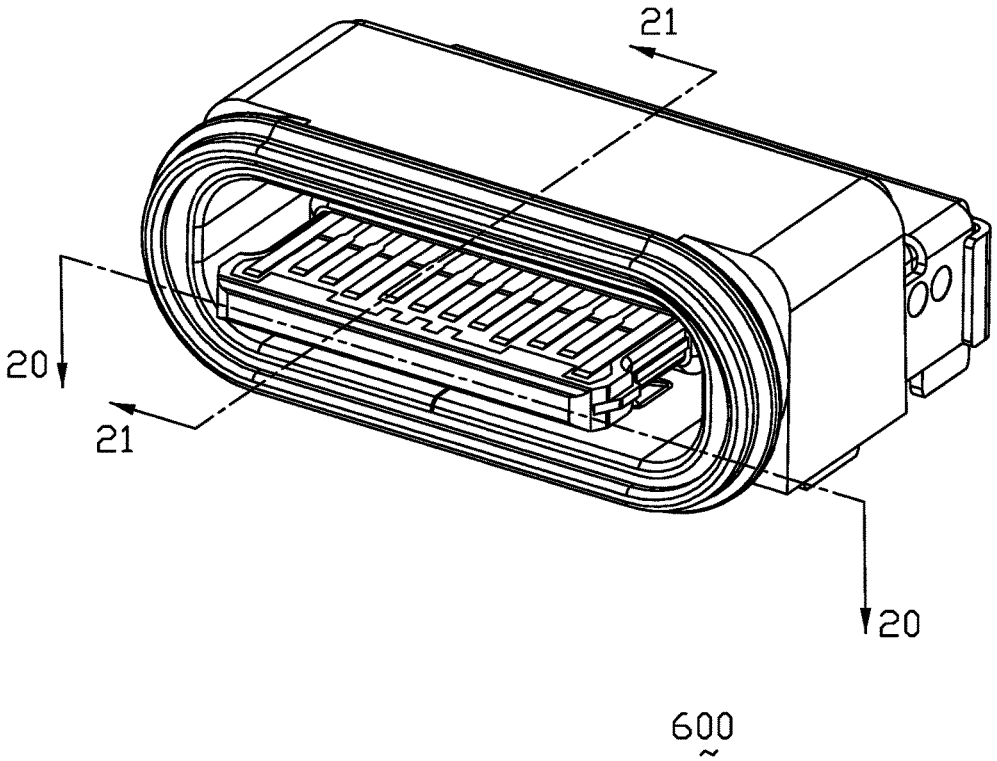
FIG. 11 is a perspective view of the electrical connector according to a second embodiment of the invention.
Figure 12:
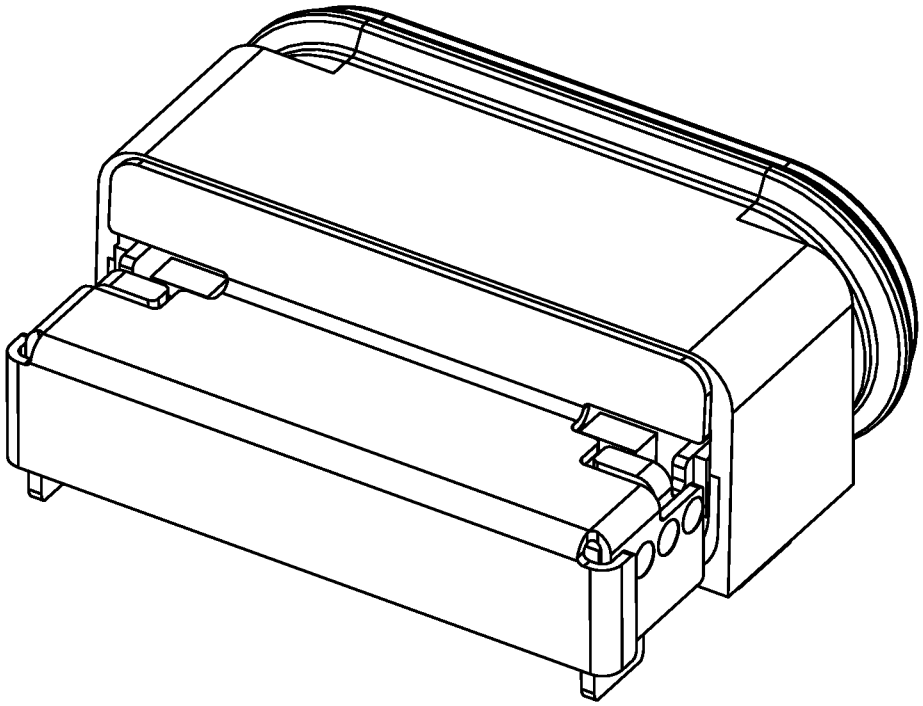
FIG. 12 is another perspective view of the electrical connector of FIG. 11.
Figure 13:
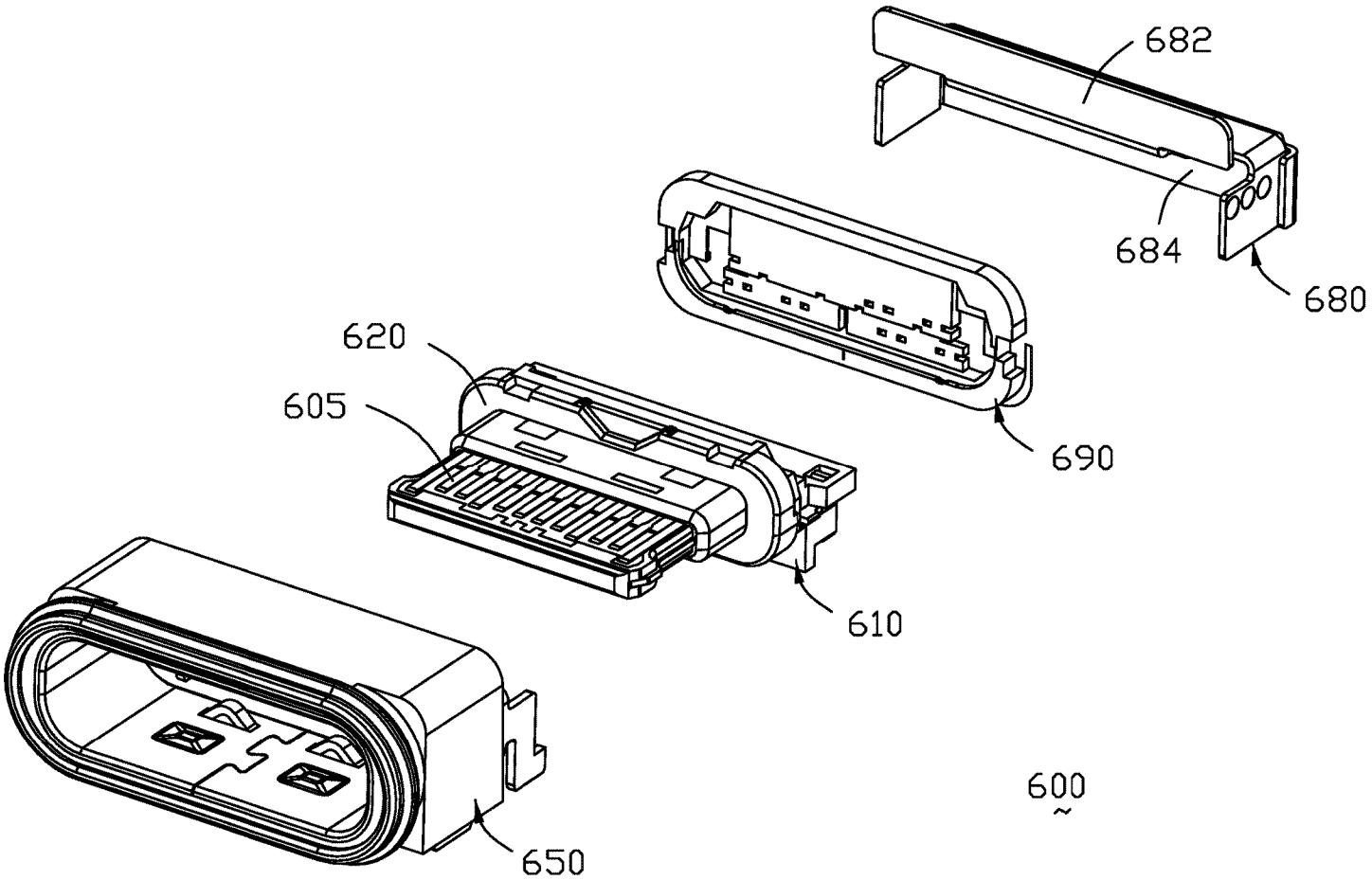
FIG. 13 is an exploded perspective view of the electrical connector of FIG. 11.
Figure 14:
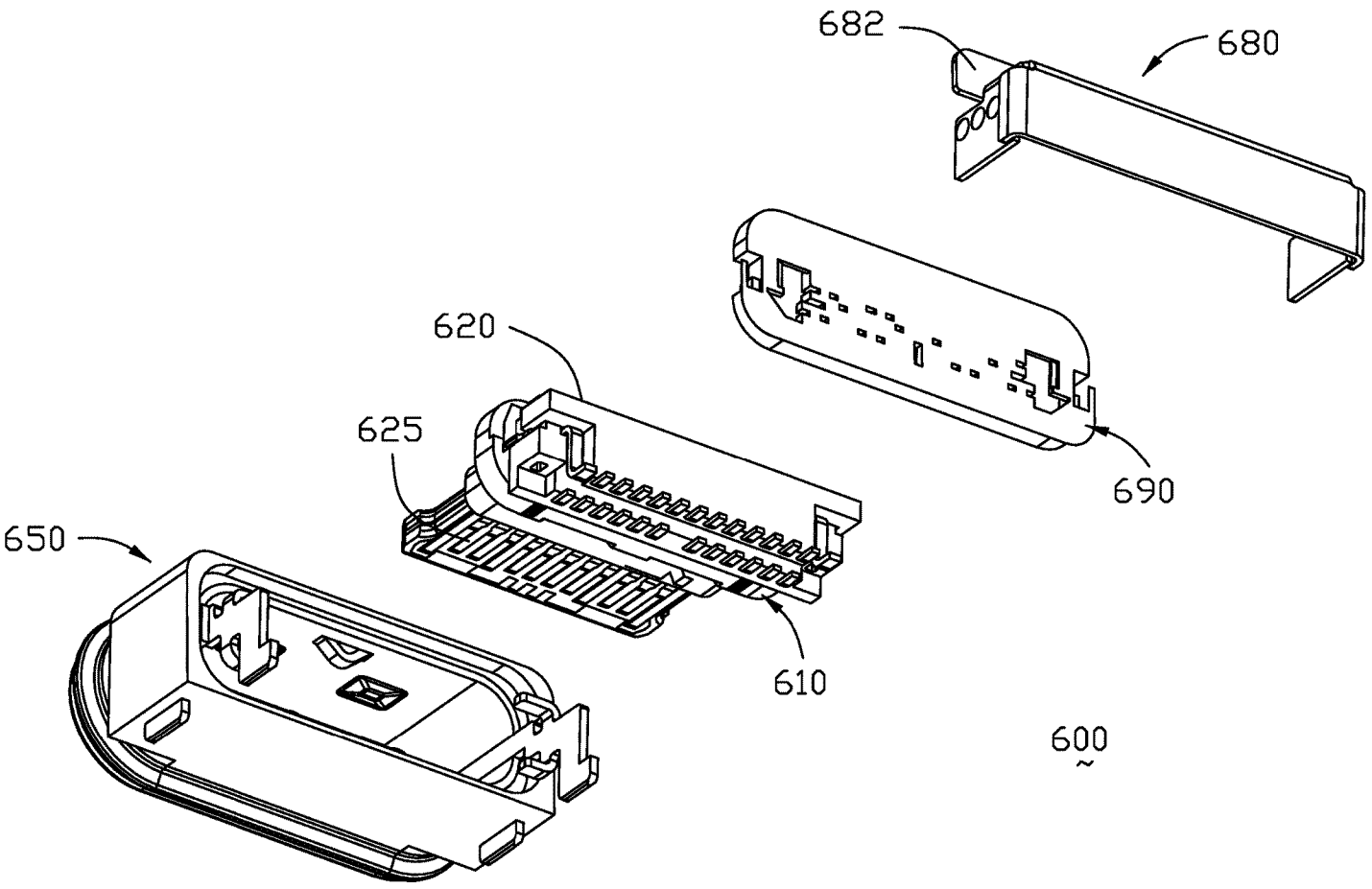
FIG. 14 is another exploded perspective view of the electrical connector of FIG. 11.
Figure 15:
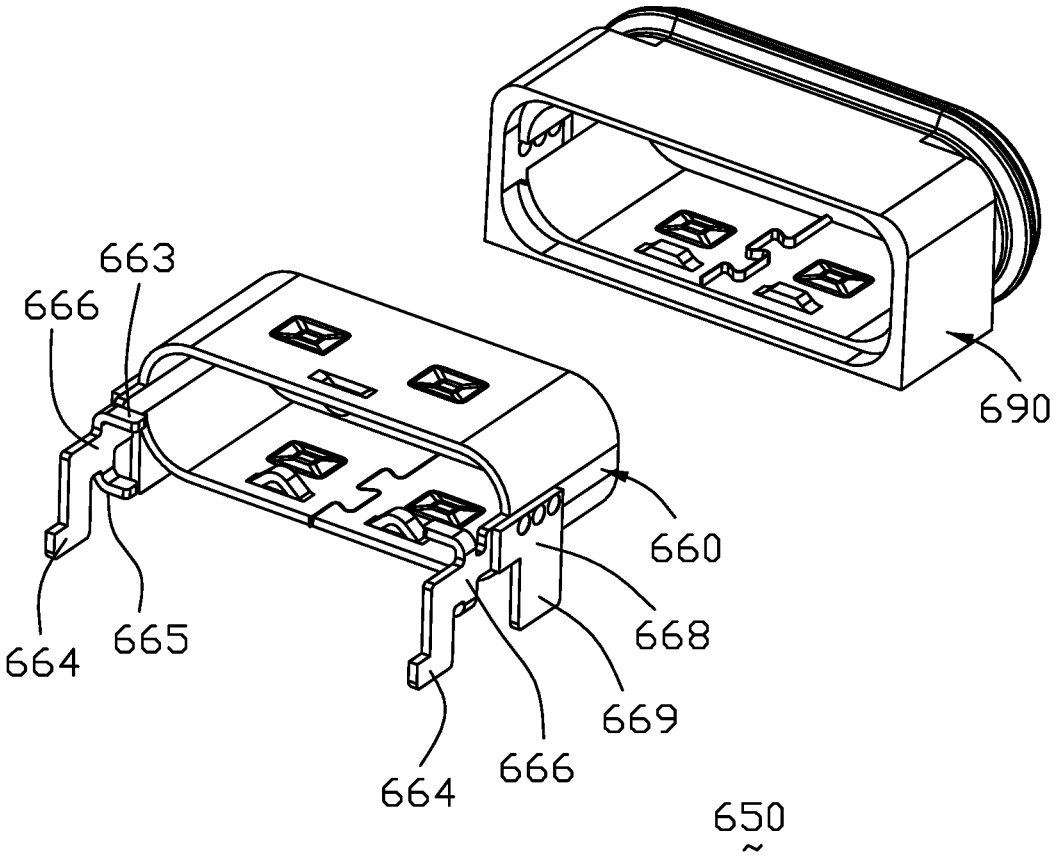
FIG. 15 is an exploded perspective view of the front cover of the electrical connector of FIG. 11
Figure 16:
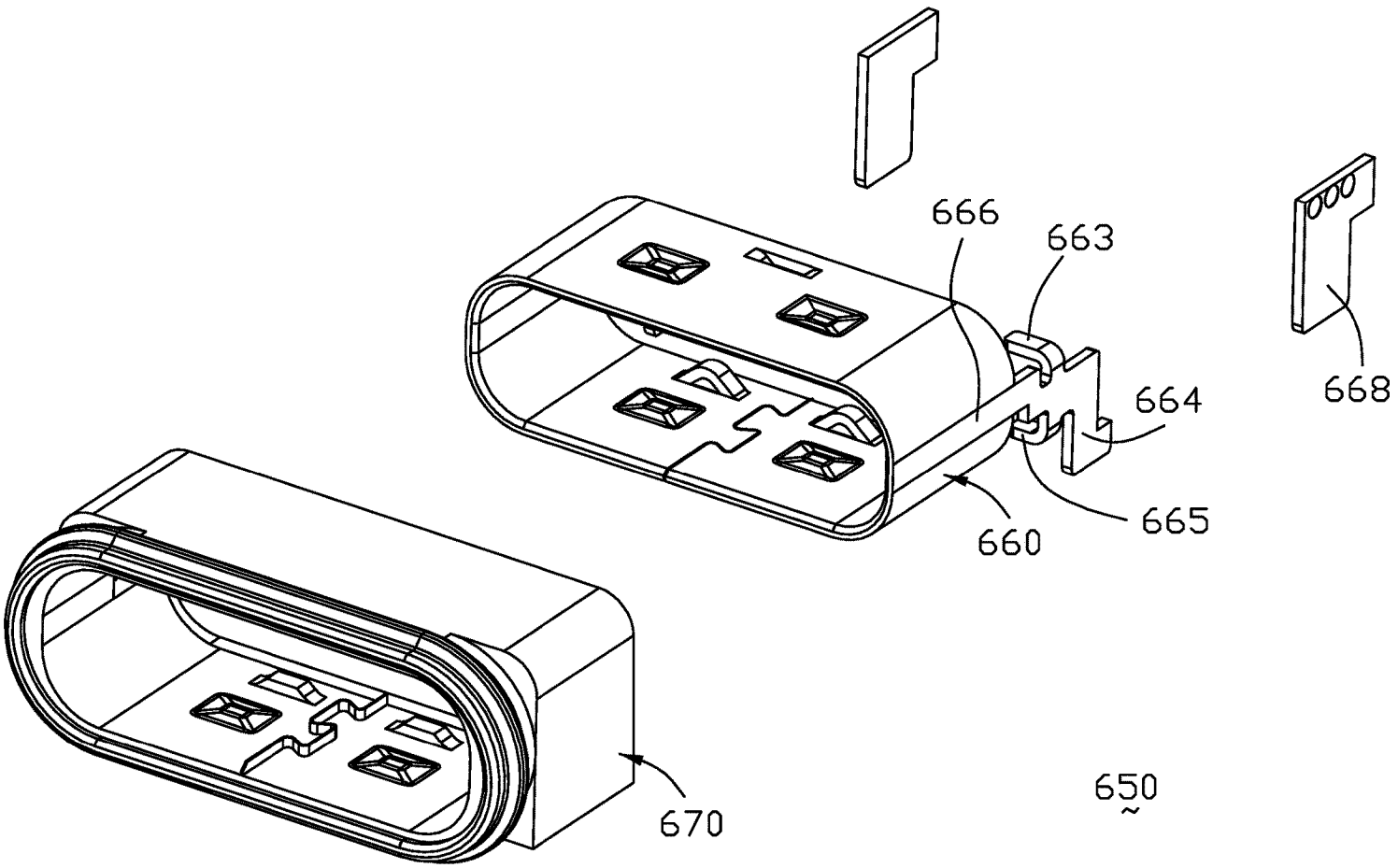
FIG. 16 is a further exploded perspective view of the front cover of the electrical connector of FIG. 11.
Figure 17:
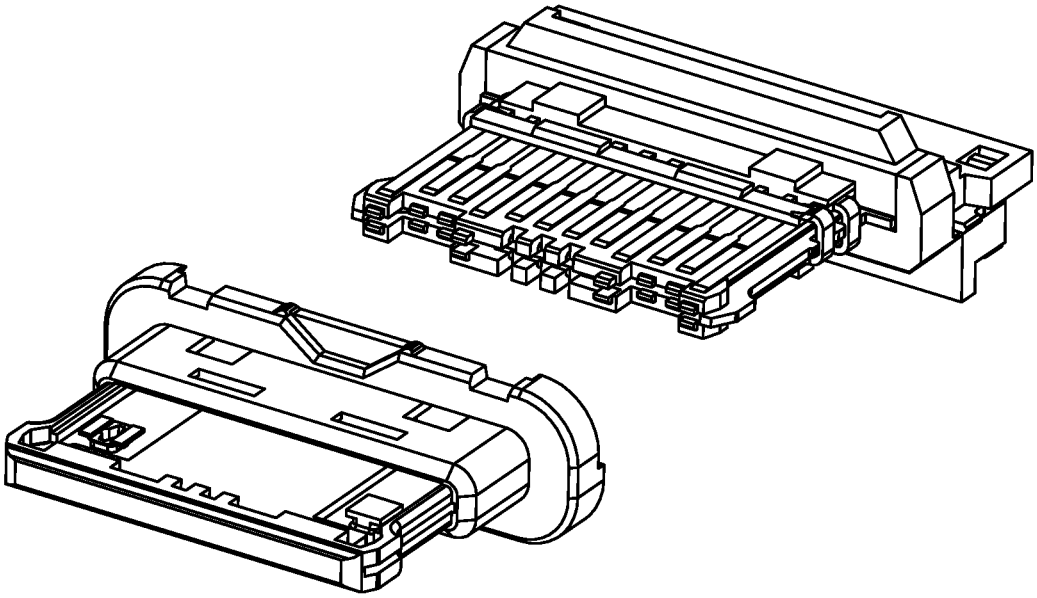
FIG. 17 is an exploded perspective view of the contact module of the electrical connector of FIG. 11.
Figure 18:
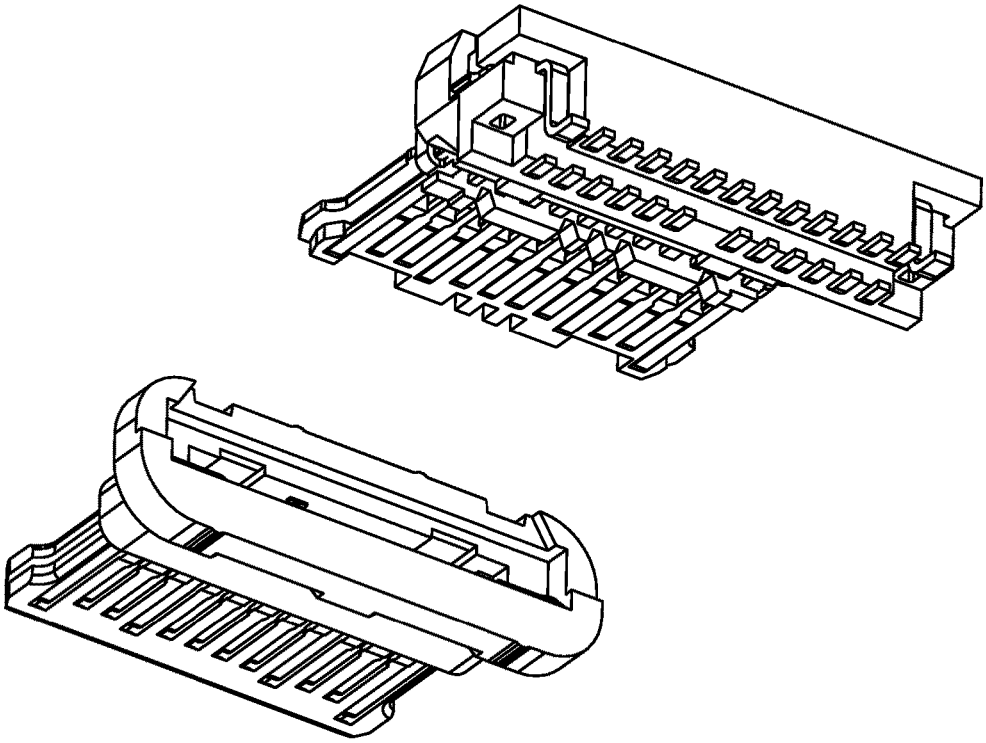
FIG. 18 is another exploded perspective view of the contact module of the electrical connector of FIG. 11.
Figure 19:
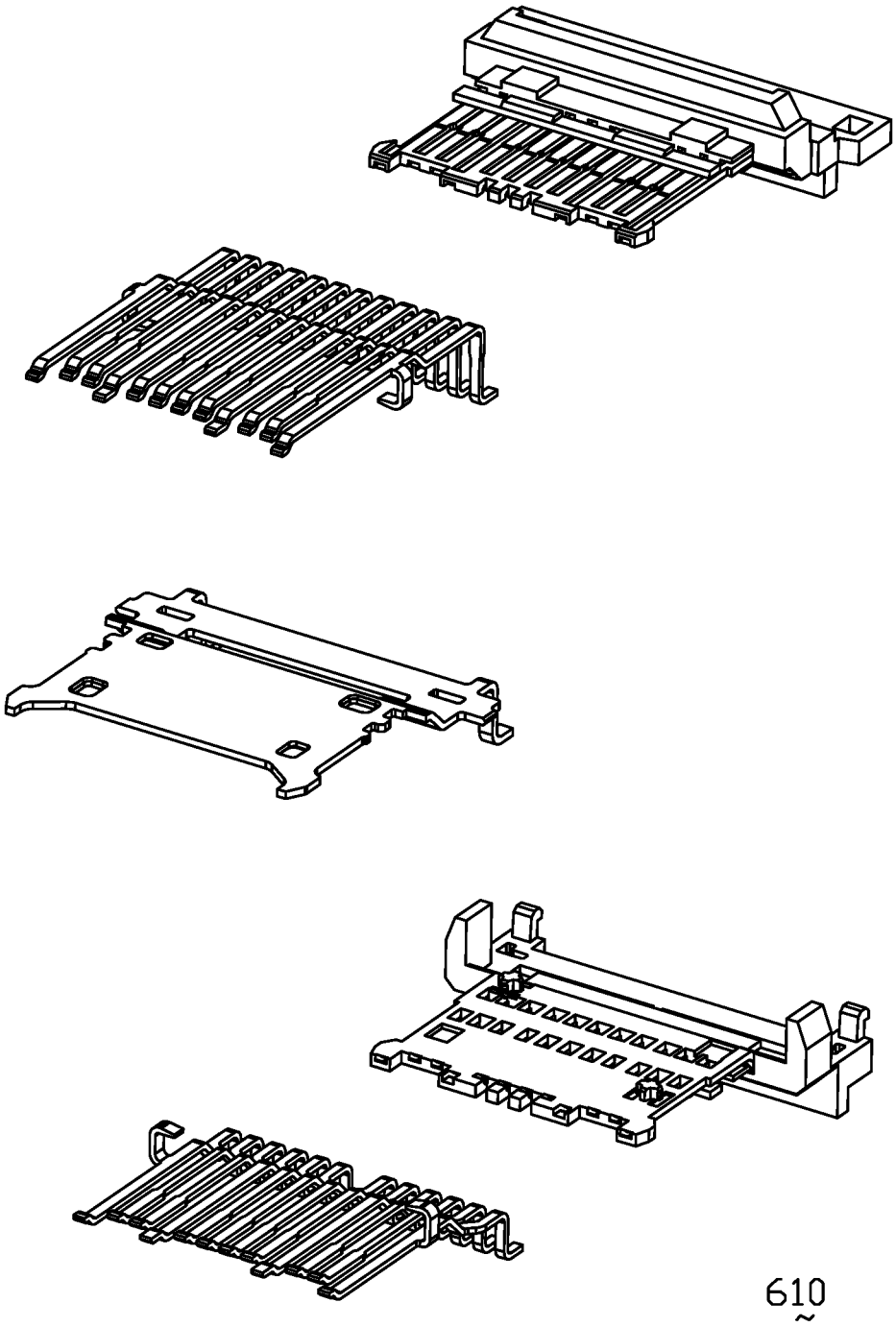
FIG. 19 is a further exploded perspective view of the contact module of the electrical connector of FIG. 17 without the third insulator.
Figure 20:
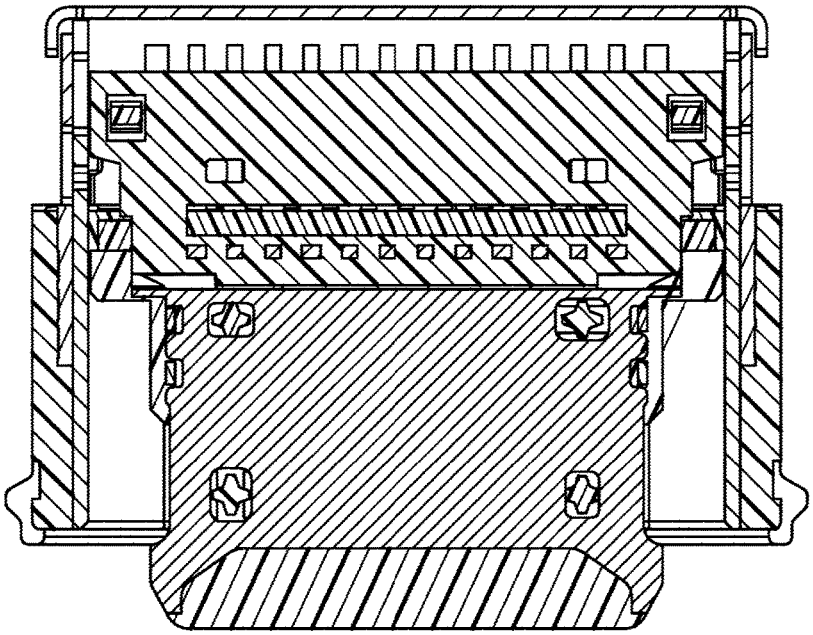
FIG. 20 is a cross-sectional view of the electrical connector of FIG. 11.
Figure 21:
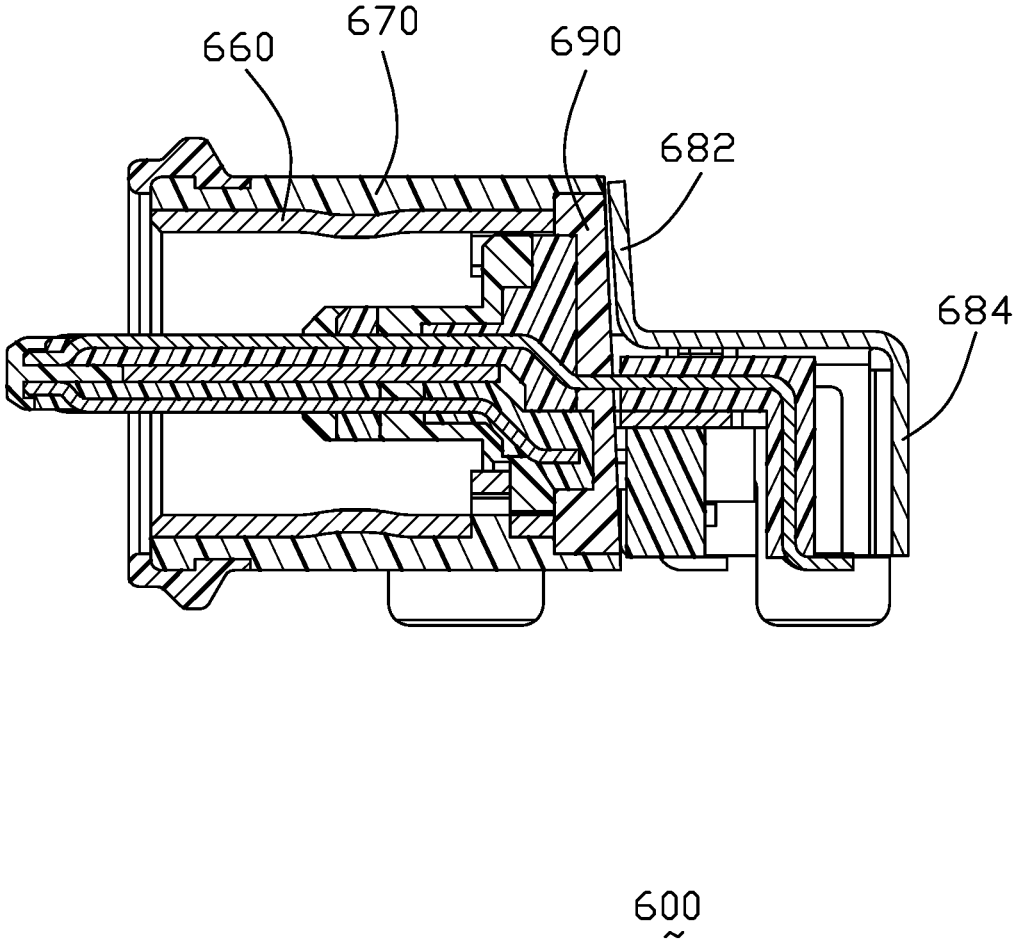
FIG. 21 is another cross-sectional view of the electrical connector of FIG. 11.

The contact module 10 is received within the inner shell 20, and the glue plate 40 is applied upon a rear end of the inner shell 20. The rear cover 30 is assembled behind the front cover 20 to enclose the base 15. As shown in FIG. 8, the glue plate 40 has a thinner upper side and a thicker lower side wherein the rear face of the glue plate 40 extends obliquely.

Notably, features of this embodiment of the invention include the integrally formed metallic inner shell and insulative outer shell wherein the inner shell includes an inner arm with the rear soldering leg and an outer arm intimately pressing the first arm, via a folded arrangement, with the front soldering leg so that the rear soldering leg is located inside of the front soldering leg in the transverse direction, and is located behind the front soldering leg in the front-to-back direction.

FIGS. 11-21 show a second embodiment which is similar to the first embodiment wherein the electrical connector 600 includes a contact module 610 enclosed within a front cover 650 and a rear cover 680. The front cover 650 includes an metallic inner shell 660 integrally formed within an insulative outer shell 670 via an insert-molding process. The contact module 610 includes an insulative housing 620 and a plurality of contacts 625 retained in the housing 620. A waterproof glue plate 690 is attached upon a rear side of the housing 620 and has a wedged structure similar to the waterproof glue plate 40 disclosed in the first embodiment. All structures of the electrical connector disclosed in the second embodiment are similar to those in the first embodiment except some noticeable differences as follows:

The primary difference is that the second/outer arm 668 having the front soldering leg 669 therewith no longer unitarily extends from the first/inner arm 666 in a folded manner but is discrete from the first arm 666 in a soldered manner instead of the folded manner disclosed in the first embodiment. Understandably, the metallic inner shell with the folded type second arm as disclosed in the first embodiment may take more material of the corresponding sheet metal relatively much material for stamping and forming, while the inner shell with the discrete second arm by soldering may save much more material of the sheet metal during stamping and forming advantageously as shown in the second embodiment. In this embodiment, the outer arm 668 is soldered primary upon the inner shell 660 to abut against the inner arm 666. Notably, the outer arm 668 may be further soldered to the inner arm 666, if necessary. Moreover, the inner arm 666 has not only the corresponding first soldering leg 664 and the lower fixing leg 665 but also further the upper fixing leg 663 for cooperating with the lower fixing leg 665 for sandwiching the housing 620 therebetween in the vertical direction perpendicular to both the front-to-back direction and the transverse direction. Furthermore, the rear cover 680 which is soldered to the inner arm 666 further includes a standing wall 682 extending from a front edge of the top wall (not labeled) and located above the rear wall 684 for superior shielding effect along the front-to-back direction.

In brief, the invention discloses in the front cover 20/650 the metallic inner shell 22/660 and the insulative outer shell 21/670 are integrally formed with each other via an insert-molding process wherein the inner shell 22/660 further includes an inner arm 223/666 with a rear soldering leg 225/664 and an outer arm 224/668 with a front soldering leg 226/669 disregarding whether the outer arm 224/668 is unitarily formed with the inner arm 223/666 in a folded manner or is discrete from the inner arm 223/666 in a soldered manner. Notably, the outer arm 224/668 is embedded within the outer shell 21/670 while the front soldering leg 226/669 extends downwardly out of the outer shell 21/670. Differently, the inner arm 223/666 including the corresponding rear soldering leg 225/664 is essentially exposed outside of the outer shell 21/670 rearwardly. The rear soldering leg 225/664 is coplanar with the inner arm 223/666, and the front soldering leg 226/669 is coplanar with the outer arm 224/668, optimally.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a front cover including a metallic inner shell and an insulative outer shell integrally formed with each other via an insert molding process, said inner shell defining a mating cavity; and a contact module including an insulative housing with a plurality of contacts retained to the housing, said contact module received within the inner shell of the front cover; wherein the inner shell further includes a unitarily rearwardly extending inner arm with a rear soldering leg thereof, and an outer arm intimately located beside the inner arm with a front soldering leg thereof; wherein the inner arm is located inside of the outer arm in transverse direction, and the front soldering leg is located in front of the rear soldering leg in a front-to-back direction perpendicular to said transverse direction; wherein the rear soldering leg is located behind the mating cavity in the front-to-back direction while the front soldering leg is located beside the mating cavity in the transverse direction.

2. The electrical connector as claimed in claim 1, wherein the outer arm is unitarily formed with the inner arm in a folded manner.

3. The electrical connector as claimed in claim 1, wherein said outer arm is discrete from the inner arm in a secured manner.

4. The electrical connector as claimed in claim 3, wherein the outer arm is secured upon the inner shell around a rear region of the mating cavity in the front-to-back direction.

5. The electrical connector as claimed in claim 1, wherein the inner arm further includes a fixing leg extending inwardly in the transverse direction toward the contact module to secure to the housing for preventing rearward movement of the housing.

6. The electrical connector as claimed in claim 5, wherein the inner arm further includes another fixing leg extending inwardly in the transverse direction toward the contact module to secure the housing not only to forwardly abut against the housing for preventing rearward movement of the housing with regard to the inner shell but also to cooperate with the fixing leg to sandwich the housing in a vertical direction perpendicular to both the transverse direction and the front-to-back direction for preventing vertical movement of the housing with regard to the inner shell.

7. The electrical connector as claimed in claim 1, wherein the inner arm extends rearwardly from a rear edge of the inner shell and is exposed outside of the outer shell while the outer arm is embedded within the outer shell except the front soldering leg.

8. The electrical connector as claimed in claim 1, further including a metallic rear cover to shield a rear side of the contact module.

9. The electrical connector as claimed in claim 8, wherein said rear cover includes a side wall secured to the outer arm.

10. The electrical connector as claimed in claim 8, wherein said rear cover includes a top wall, and a pair of side walls and a rear wall to enclose the rear side of the contact module.

11. The electrical connector as claimed in claim 8, further including a vertical waterproof glue plate attached upon a rearward face of the housing around a rear edge of the inner shell, wherein said waterproof glue plate forms an oblique rearward surface rearwardly facing the rear cover in the front-to-back direction.

12. The electrical connector as claimed in claim 11, wherein said rear cover further includes a standing wall extending from a front edge of the tope wall and located above the rear wall to cover said waterproof glue plate.

13. The electrical connector as claimed in claim 1, wherein the front solder leg is coplanar with the outer arm in an outer vertical plane, and the rear soldering leg is coplanar with the inner arm in an inner vertical plane inside of said outer vertical plane.

14. An electrical connector comprising:

a front cover including a metallic inner shell and an insulative outer shell integrally formed with each other via an insert molding process, said inner shell defining a mating cavity; and a contact module including an insulative housing with a plurality of contacts retained to the housing, said contact module received within the inner shell of the front cover; wherein the inner shell further includes an inner arm unitarily extending from a rear edge of the inner shell with a rear soldering leg thereof, and an outer arm intimately located beside the inner arm with a front soldering leg; wherein the rear soldering leg is located behind the mating cavity in the front-to-back direction while the front soldering leg is located beside the mating cavity in the transverse direction.

15. The electrical connector as claimed in claim 14, wherein the outer arm is unitarily formed with the inner arm in a folded manner.

16. The electrical connector as claimed in claim 14, wherein said outer arm is discrete from the inner arm in a secured manner.

17. The electrical connector as claimed in claim 16, wherein the outer arm is secured upon the inner shell around a rear region of the mating cavity in the front-to-back direction.

18. An electrical connector comprising:

a front cover including a metallic inner shell and an insulative outer shell integrally formed with each other via an insert molding process, said inner shell defining a mating cavity; and a contact module including an insulative housing with a plurality of contacts retained to the housing, said contact module received within the inner shell of the front cover; wherein the inner shell further includes an inner arm unitarily extending from a rear edge of the inner shell, and an outer arm intimately located beside the inner arm with a front soldering leg; wherein a waterproof glue plate is attached to a rearward surface of the housing;

wherein said waterproof glue plate forms an oblique surface with a thinner upper section and a thicker lower section thereof.

19. The electrical connector as claimed in claim 18, wherein the inner shell further includes rear soldering leg behind the front soldering leg in the front-to-back direction.

* * * * *